US005546671A

United States Patent [19]

Kehoe

[11] Patent Number: 5,546,671

[45] Date of Patent: Aug. 20, 1996

[54] MULTI-PURPOSE ROOFING TOOL KIT

[76] Inventor: Ted P. Kehoe, 479 Moss St., Chula Vista, Calif. 91911

[21] Appl. No.: 177,511

[22] Filed: Jan. 4, 1994

[51] Int. Cl.[6] ..... G01D 21/00

[52] U.S. Cl. ..... 33/648; 33/760; 33/354; 33/485

[58] Field of Search ..... 33/333, 354, 451, 33/434, 485, 489, 490, 491, 518, 526, 527, 646, 647, 648, 649, 760; 2/24; 182/129, 230; 297/423.1, 423.11, 423.39, 423.44; 52/105

[56] References Cited

U.S. PATENT DOCUMENTS

| | | | |
|---|---|---|---|
| 165,880 | 7/1875 | Schneider | 33/648 |
| 463,106 | 11/1891 | Dees | 33/646 |
| 772,521 | 10/1904 | Knox | 33/648 |
| 1,011,390 | 12/1911 | Stubbs | 33/646 |
| 1,348,683 | 8/1920 | Aldenbruck et al. | 182/129 |
| 1,454,401 | 5/1923 | O'Neill | 182/129 |
| 2,715,780 | 9/1955 | Hageman | 33/188 |
| 2,716,288 | 8/1955 | Geddis et al. | 33/188 |
| 2,887,781 | 5/1959 | Mills | 33/158 |
| 2,889,632 | 6/1959 | Longhi | 33/188 |
| 2,891,318 | 6/1959 | Harrison et al. | 33/188 |
| 3,110,113 | 11/1963 | Baker | 33/188 |
| 3,257,671 | 6/1966 | Crookston | 7/8.1 |
| 3,656,809 | 4/1972 | Ronning | 297/423.1 |
| 4,010,592 | 3/1977 | Nixon | 52/748 |
| 4,056,889 | 11/1977 | Barnett, III | 33/188 |
| 4,096,631 | 6/1978 | Ward | 30/294 |
| 4,110,911 | 9/1978 | Sucheck | 33/188 |
| 4,183,144 | 1/1980 | Barnett, III | 33/188 |
| 4,226,388 | 5/1981 | Flood | 52/748 |
| 4,285,134 | 8/1981 | Schmanski | 33/188 |
| 4,310,134 | 1/1982 | Schopp et al. | 182/129 |
| 4,541,217 | 9/1985 | Stewart | 52/518 |
| 4,747,470 | 5/1988 | Fernandez | 182/230 |
| 4,773,165 | 9/1988 | Kozyrski | 33/613 |
| 4,785,606 | 11/1988 | Burton | 52/749 |
| 4,798,264 | 1/1989 | Miller et al. | 182/230 |
| 4,866,847 | 9/1989 | Batrack et al. | 30/293 |
| 4,936,021 | 6/1990 | Fremette et al. | 33/649 |
| 5,018,279 | 5/1991 | Williams | 33/649 |
| 5,056,234 | 10/1991 | Han | 33/494 |
| 5,311,670 | 5/1994 | Tomoiaga | 33/648 |

FOREIGN PATENT DOCUMENTS

| | | | |
|---|---|---|---|
| 2576054 | 7/1986 | France | 33/648 |
| 374512 | 6/1932 | United Kingdom | 182/230 |

*Primary Examiner*—Thomas B. Will

*Attorney, Agent, or Firm*—Henri J.A. Charmasson; John D. Buchaca

[57] ABSTRACT

A set of cooperating tools to assist a roofer in the multiple tasks involved in covering a roof surface with shingles or tiles, and numerous other chores associated with wall and roof construction, protection and maintenance. The set includes a straight-edge ruler, shingle and tile cutting jig, workbench, knee-rests, blade knife, gauges, levels and various accessories that can be synergistically combined to accurately and safely measure, cut and install shingles or tiles while standing on a slanted roof surface under precarious conditions.

19 Claims, 10 Drawing Sheets

1
2
64L
18L
14
16L
3
18C
15
16C
4
19
17
76
5
19
17
16R
64R
18R
116E
115U
11
6
113T
7
30
12
29C
8
105D
106D
108L
25
29
100D
107A
107S
103
108R
106P
105P
9
97
98
100P
10
13

31
32
33
30
7
45L
45R
44L
44R
25
14
3
4
48
50
47
29
24
46L
46R
15
5
41
36
35
37
42
43
39
38
40
52
51D
29C
34
28D
28P
19H
23
19
67
22
26
27
18D
18P
16L
18L
19T
20
17
21

4,5
67
17
169S
169S
81
69
76
66
73
68
71
70
72
74
75

87V 90
77
78
82
83
5
88V
84
19R
69
19
88H
87H
19H
80
81
19R
84
19L
19
86
6

84
85
5
4
89
86
4
69
79
76
85
4
5

FIG. 28
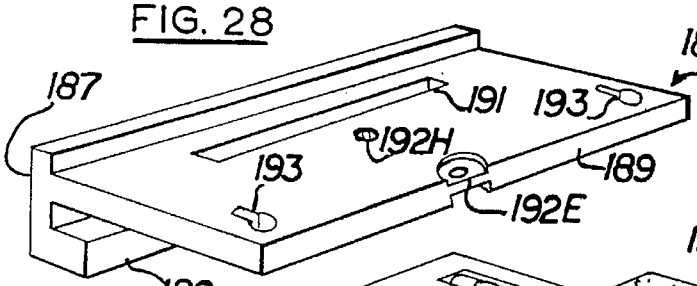
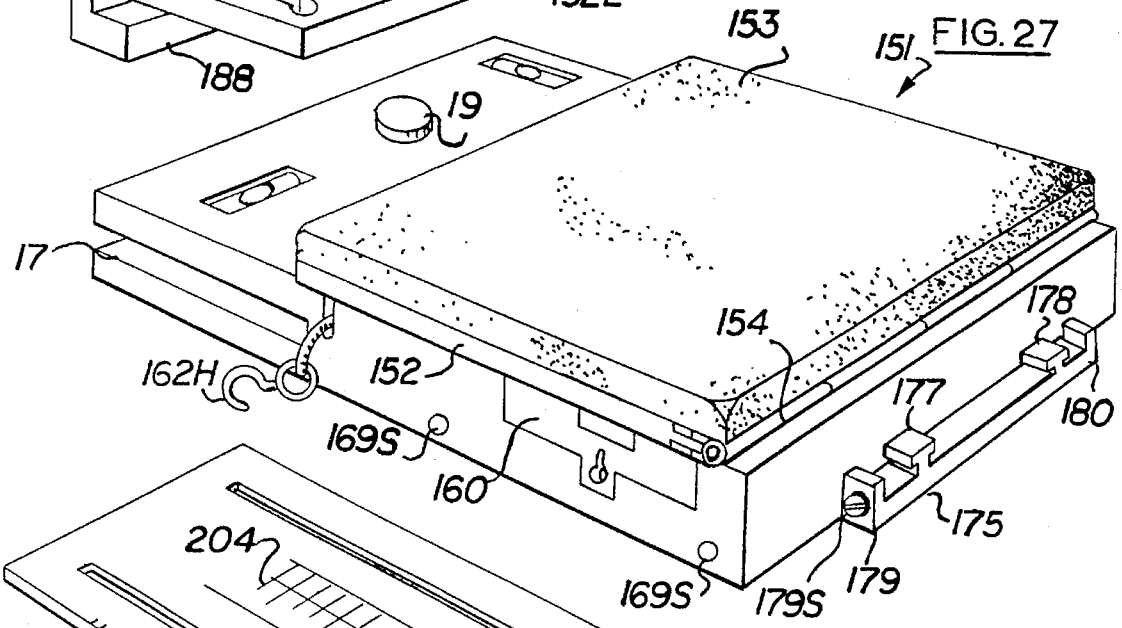
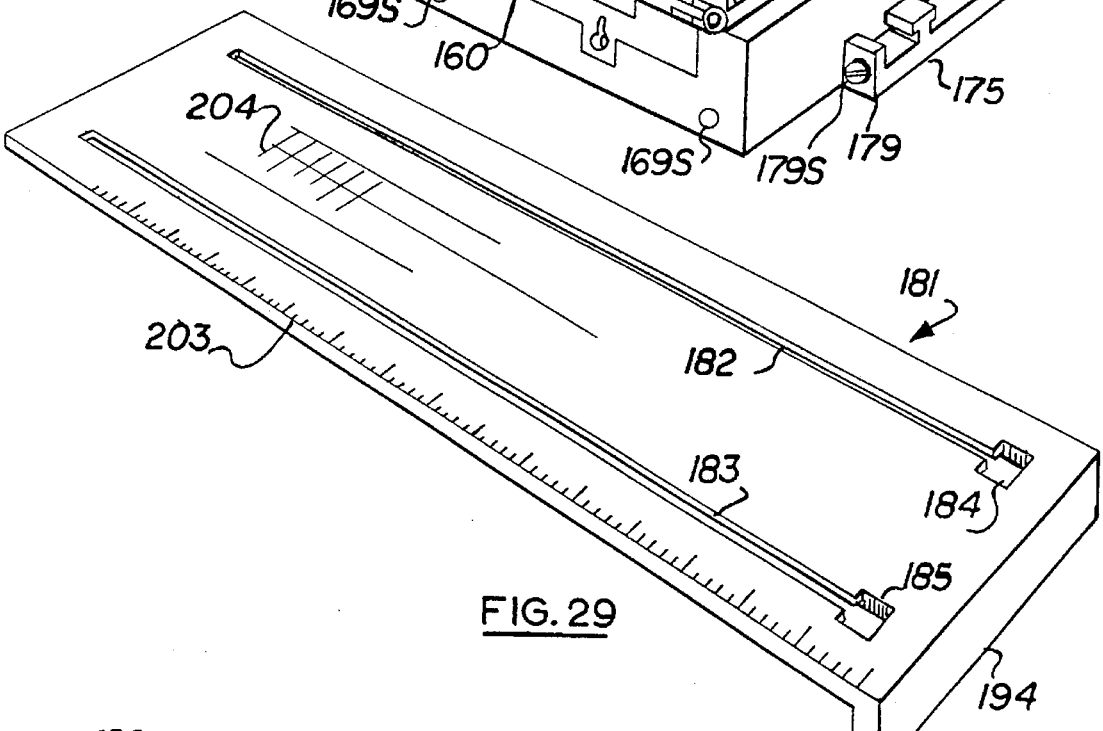
FIG. 29
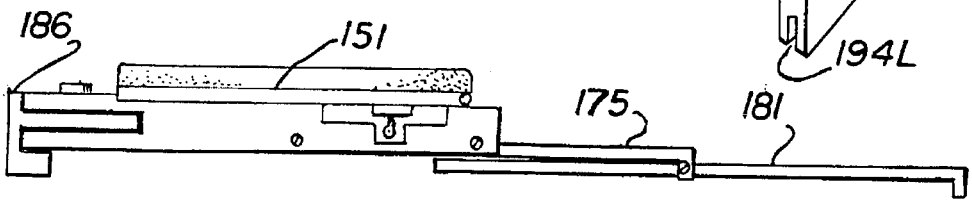
FIG. 30

MULTI-PURPOSE ROOFING TOOL KIT

FIELD OF THE INVENTION

The present invention relates to manufacturing jigs and templates, and more specifically to shingle-gauging, aligning and cutting tools used by roofers.

BACKGROUND OF THE INVENTION

Shingles for covering roofs or walls of buildings usually come in large sheets of textured material in typical sizes of 30 cms×90 cms (12×36 inches) and 32.5 cms×97.5 cms (13×39 inches). They are laid down in a vertically overlapping and horizontally offset pattern in combination with interlaid strips of felt or other waterproof material, then nailed down to the underlying plywood or lath structure. The installation of shingles on roofs or outside walls of a building is an arduous, hazardous and time-consuming operation. Roofers must work on steep surfaces, bending or kneeling to cut, position then hammer down or staple shingles in a regular and esthetically attractive pattern. Roofers are often paid as a function of the total area they cover or the number of shingle packs they use in a workday. Accordingly, they must strive to work in an efficient, yet rapid manner. When covering a rectangular area such as the face of a wall or the slope of a roof, roofers have found it most efficient and practical to lay shingles in a diagonal pattern beginning in the lower left corner of the area to be covered in the case of a right-handed roofer, or in the lower right corner in the case of a left-handed roofer. In most cases, the roofer begins by trimming down the pre-existing roofing material by a few centimeters around the eaves making sure that the trimmings are swept clear off the surface to be roofed where they could interfere with the correct installation and waterproofing effect of the new roofing material. In order to establish the base of the diagonal shingle-laying pattern, the roofer must cut a first set or rack of shingles wherein each shingle is shorter than the one that it overlaps by a fixed distance called the sidelap. Depending upon the amount of weather exposure between the shingles, i.e., the width by which an underlying shingle protrudes from under the one immediately above it, a rack comprises an uncut base shingle and 5 to 6 cut shingles of progressively shorter lengths wherein the top and shortest shingle has a length corresponding approximately to the width of the sidelap. Depending upon the vertical dimension of the roof, the roofer must also cut shingles to create a specific number of racks. As the roofing operation reaches the opposite vertical edge of the roofing surface, racks must be used in a reverse pattern with the shortest shingle at the base and the longest at the top. Most often the final rack of shingles must be trimmed to better match the edge of the roof. Shingles must also be gauged and cut in oblique vertical forms when covering the edges of trapezoidal roof areas as well as when meeting valleys and ridges or covering gables. When installing clay or fibered cement tiles rather than shingles, the roofer is confronted with unique tile-cutting difficulties due to the weight, thickness, and undulated shape or other unique mechanical characteristic of the tile. Tiles must often be cut to fit row ends, valleys and hips with an electric saw above the roof surface in very precarious positions.

Roofers are often times called upon to install skylights, dormers, awnings, gutters, facia boards, sidings, shiplaps and other structures that require a multiplicity of special tools.

It is no surprise that the prior art offers a variety of gauges and cutting guides for facilitating and expediting the various roofing operations. Templates such as the one disclosed in U.S. Pat. No. 4,266,388 Flood, aligning fixtures such as the one disclosed in U.S. Pat. No. 4,183,144 Barnett, III, and cutting guides such as the one disclosed in U.S. Pat. No. 4,010,582 Nixon are very practical devices. However, their weights, sizes and general unwieldiness can be a real hindrance which too often complicates rather than alleviates the tasks of the tradesman operating on a slanted roof top.

There is a need for a simple, yet practical set of devices which would cooperate when combined in different arrangements to assist the roofer in the numerous aspects of a roofing operation.

SUMMARY OF THE INVENTION

The principal and secondary objects of the present invention are to replace the various bulky roofing jigs of the prior art by a set of simple and lightweight tools which can be synergistically combined in various arrangements to assist the roofer in the measuring, cutting, and positioning of shingles or roof tiles, and numerous other tasks associated with roofing; to add to these combinations of tools kneel supports which can be easily repositioned for the most comfortable and safest working position of the roofer under the most precarious working conditions; and to provide various aligning and shingle-cutting aids which until now, have not been available to the roofer.

These and other valuable objects are achieved by a set of coordinated tools which are housed in a small oblong receptacle that can act as a roof-trimming collector and workbench. The various tools include a straight-edge ruler, movable knee-pads, a shingle and tile cutting or scoring jig, weather exposure and sidelap setting gauges, a workbench as well as a special cutting knife wherein the above-described functions are shared by, and distributed among, several of the tools.

BRIEF DESCRIPTION OF THE DRAWING

FIG. 27 is a perspective view of an alternate embodiment of the knee-pads;

FIG. 28 is a perspective view of a knee-pad slot filler and clamping plate;

FIG. 29 is a perspective view of a gauge plate extension;

FIG. 30 is a side view of the combined assembly of a knee-pad, slot filling and clamping plate, and gauge plate;

DESCRIPTION OF THE PREFERRED EMBODIMENT OF THE INVENTION

Figure 1:
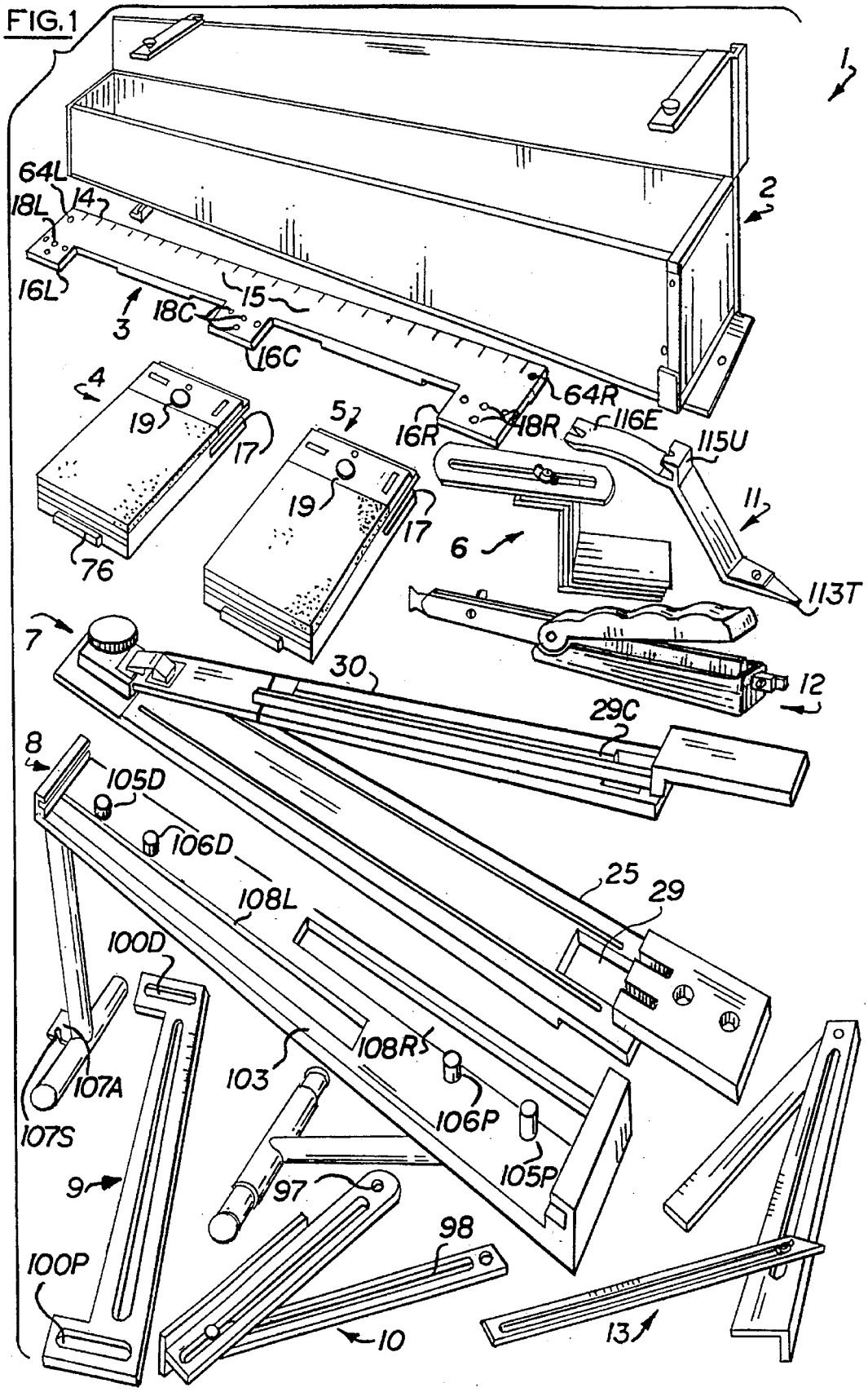
FIG. 1 is a perspective view of the entire tool set.

Referring now to the drawing, there is shown in FIG. 1 a set or kit of cooperating tools adapted for use by a roofer in preparing and laying out shingles or tiles. The set of tools 1 comprises a carrying box 2 which can also be used as a trimming debris collector, and as a support for a tile cutter. A ruler 3 with a straight edge for sizing and positioning shingles has attachments for cooperation with a pair of knee-pads 4, 5 and a shingle and tile cutting guide 7. Two knee-pads 4, 5 can also be used for positioning shingles and tiles and to set a predetermined weather exposure and side-lap when interconnected by an adjustable connecting handle 6, or by the ruler 3.

A workbench 8 is adapted to support the cutting guide 7 or the tool box 2. A ruled sliding work-support 9 and a ruled swinging work-support 10 are designed to work in cooperation with the cutting guide 7 when it is mounted on the tool box 2 acting as a bench or on the workbench 8. A brace 11 can be used to support the tool box in an horizontal position on a sloping roof surface, as a staple remover, nail puller, shingle scrapper, or as a clamp for collected shingle wrappers which when counted can be used to determine the number of shingles installed by a roofer. A cutting knife 12 has an adjustable second handle for two-handed operation. A tile cutting gauge 13 has two swinging arms for sizing a variety of row end areas to be tiled, and for measuring the pitch of the roof.

Figures 2, 3, 4, 5, 6:
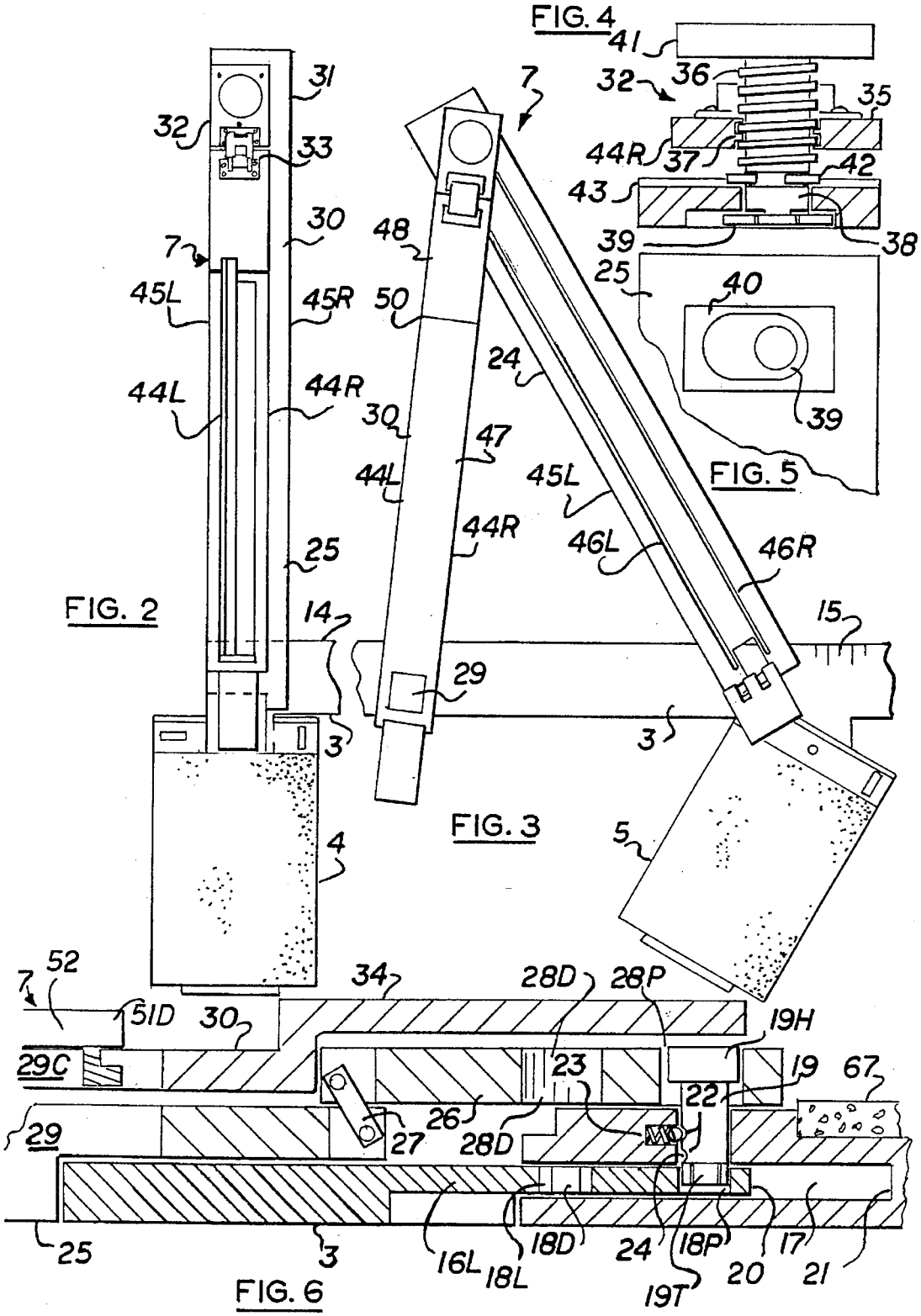
FIG. 2 is a top plan view of a ruler, cutting guide and knee-pad assembly.
FIG. 3 is a top plan view of the ruler, cutting guide and knee-pad assembly positioned to make oblique cuts.
FIG. 4 is a cross-sectional view of the chop-arm height adjustment mechanism.
FIG. 5 is a partial bottom plan view thereof.
FIG. 6 is a partial, median cross-sectional view of the ruler, cutting guide and knee-pad assembly.
Figures 7, 8, 9:
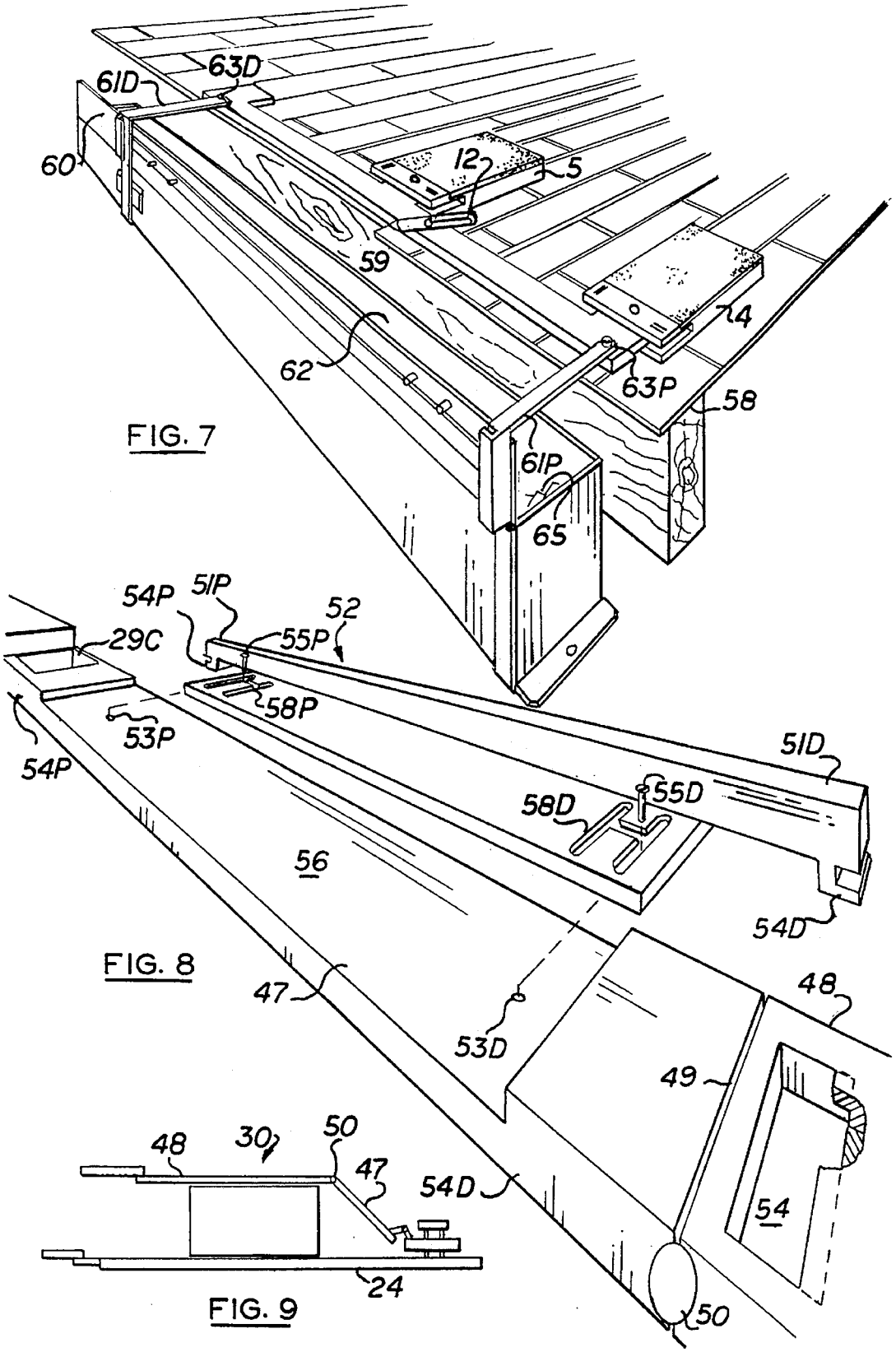
FIG. 7 is a perspective view of the ruler, knee-pads, and tool box assembly used in a roof trimming operation.
FIG. 8 is a perspective view of the saw guide assembly.
FIG. 9 is a simplified side view of the cutting guide used on a bulky workpiece.

The ruler 3 is the basic tool used by the roofer to cut racks of shingles. The ruler has a straight edge 14 along one of its longest sides. Markings 15 along the straight edge indicates the various lengths of shingles which constitute a rack using standard sidelap and weather exposure measurements. Three projections 16L, 16C, and 16R along the side of the ruler opposite the straight edge are each designed to connect to one of the two knee-pads 4, 5 in various configurations, as illustrated in FIGS. 2, 3, and 7. When one or both of the two knee-pads are attached to the ruler, the weight of the roofer bearing on either or both of the knee-pads stabilizes the ruler. This allows the roofer to use both hands to either manipulate the cutting knife 12 or to secure the shingle with one hand while cutting with the other. Typically, a right-handed roofer would connect the knee-pads to the left projection 16L and the central projection 16C of the ruler. A left-handed roofer would connect the knee-pads to the right side projections 16R and the central projection 16C. As more specifically illustrated in FIGS. 1 and 6, each knee-pad has a slot 17 running horizontally under the most distal third portion of the knee-pad. The slot 17 has the same width and is located at the same level as each one of the ruler connecting projections 16L, 16C and 16R. A set of four bores 18L, 18C and 18R are positioned and sized to engage a vertical pin 19 passing through a median section of the slot. When the pin 19 is engaged through one of the most distal bores 18D of each projection, the forward edge 20 of the projection abuts the vertical end 21 of the slot 17. The pad is then locked into an orthogonal orientation in relation to the straight edge 14 as shown in FIG. 2. When the pin 19 is engaged into the proximal bore 18P of one of the projections, the knee-pad can be placed at a variety of orientations such as the one illustrated in FIG. 3. The wall of each bore 18D, 18P has an hexagonal configuration matched by the tip 19T of pin 19. The wall of the pin has two superimposed notches 22 which are alternately engaged by a spring-biased ball mechanism 23 positioned into the pin passage 24 through the roof of the slot. The pin can thus be moved from the locked position illustrated in FIG. 6 to an unlocking raised position. The hexagonal interface between the tip 1AT of the pin and the bore 18P places the knee-pad into an oblique but stable position in relationship to the ruler 3.

The ruler 3 and knee-pads 4, 5 are also designed to interface with the cutting guide 7. The cutting guide has a base plate or sole plate 25 adapted for mounting either on top of the tool box 2 or on top of the folding bench 8. However, its flat undersurface can also lie on the same surface as the ruler 3 and knee-pads 4, 5 in either a perpendicular orientation in relation to the straight edge 14 as illustrated in FIG. 2, or in an oblique orientation as illustrated in FIG. 3. As more specifically shown in FIG. 6, the proximal end 26 of the sole plate is articulated by a pair of swinging hinges 27, and can assume three distinct positions in relationship to the sole plate 25—an upper position illustrated in FIG. 6 above the level of the sole plate, a central position in line with the sole plate, and a third position below the level of the sole plate. Two vertical bores 28D and 28P in the swinging end 26 are sized and positioned to engage over the head 19H of the knee-pad locking pin 19. A window 29 cut into the proximal end of the base plate 25 provides a convenient access for nailing a shingle located underneath. As shown in FIGS. 2 and 3, the cutting guide 7 has a chop arm 30 which is hingedly connected to the distal end 31 of the base plate by means of an height-adjustable support assembly 32 and a eccentric hinge 33. The proximal end 34 of the chop arm is vertically offset and sized to rest above the swinging end 26 of the base plate.

The chop arm support assembly 31, more specifically illustrated in FIGS. 4 and 5, comprises a horizontal hinge plate 35 riding on a vertical worm gear 36 passing through a threaded bore 37 in the center of the hinge plate. The worm gear shaft 38 is rotatively held at its base by a bearing plate 39 nested in a rectangular cavity 40 in the base plate 25 of the cutting guide. A knob 41 at the upper end of the shaft is used to adjust the vertical position of the hinge plate 35. A clamp or cotter pin 42 engages the shaft 38 just above the surrounding upper surface area 43 of the base plate and prevents the end of the shaft and the bearing plate 39 from dropping out of the rectangular cavity 40. With the clamp or cotter pin 42 removed, the whole chop arm assembly can be shifted laterally between two positions wherein one of the edges 44R or 44L of the chop arm can be aligned with one of the lateral edges 45R or 45L of the base plate.

Two parallel longitudinal grooves 46L and 46R are positioned to match the lateral edges 44L, 44R of the chop arm 30 when it is shifted into its left and right positions. Accordingly, when a shingle or other roof covering element is clamped between the base plate 25 and the chop arm 30, either edge of the chop arm can be used as a knife guide in conjunction with one of the grooves to allow a straight and clean cutting of a section of the shingle.

The chop arm 30 is split into a long proximal section 47 and an distal section 48 along a transversal line 49 located about ⅓ of the total length of the chop arm from the support assembly 32. A hinge 50 allows downward rotational movement of the proximal section 47 as illustrated in FIG. 9 in order to accommodate tiles or other work pieces having a thickness beyond the adjustable range of the arm support assembly 32. The two sections 47, 48 of the chop arm 30 are rigidly locked into an in line position by either one of the projecting ends 51P, 51D of a reversible and slidingly adjustable saw guide 52 installed in the proximal portion 47 of the chop arm as illustrated in FIG. 8. The saw guide can be reversed front-to-back for either right-hand or left-hand use. Tongs 54P and 54D in the projecting ends of the sawing guide are shaped and dimensioned to slide sideways and front and back within a legered mortise 54 in the upper surface of the chop arm distal section 48. The tongue of the proximal end 51P is positioned to ride freely within the window 29C in the proximal end of the chop arm, and matching the window 29 in the base plate. The saw guide 52 is kept in a parallel orientation in relation to the chop arm by two vertical screws 55P and 55D passing through the saw guide, riding within a pair of H-shaped slots 57P and 57D and engaging threaded holes 53D, 53P at either end of the depressed area 56. The saw guide can not only be shifted front and back to lock the two sections of the chop arm, but can also be used as a convenient guide for a hand-saw used for cutting tiles and other thick roofing elements.

FIG. 7 illustrates another use of the ruler 3 in conjunction with the knee-pads 4, 5 and the tool box 2 when trimming back a roof edge of a strip 58 of previous roofing material. The cover 60 of the box is equipped with a pair of L-shaped brackets 61P, 61D which are dimensioned to place the opening 62 of the box right under the strip of material to be cut when locking screws 63P and 63D are engaged into mating threaded holes 64L and 64R in the distal corner ends of the ruler 3. Accordingly, with the ruler, pads and box assembly immobilized by the weight of the roofer resting on the knee-pads 4, 5, the roofer can use both hands to manipulate the knife 12 and cut the roof trimmings 65 and let them fall into the box 2.

The knee-pads 4, 5 can be used independently of the ruler 3, either singly or tied together by the handle connector 6, to position a shingle as will be explained by reference to FIGS. 10–12. Each knee-pad consists of a rectangular slab 66 of aluminum or hard plastic with the frontal, horizontal slot 17 cut through a third of the pad length. A cushion 67 of rubber or other padding material extends over approximately three quarters of the slab upper surface. A rectangular depression 68 in the undersurface of the knee-pad extends from the rear edge of the pad over approximately three quarters of its length. A gauge plate 69 is slidingly mounted within the depression 68 and is retained therein by a pair of flat-head nibs 70 capturing a pair of corresponding longitudinal, parallel slots 71 in the gauge plate. The gauge plate 69 has a width commensurate with the width of the depression 68, half the length of the depression, and a thickness slightly smaller than the depth of the depression 68. A pair of bores 72 at the ends of the slots 71 allows for disconnecting the gauge plate from the knee-pad. A slightly arcuate lift-spring 73 lying in a longitudinal groove 74 in the center of the depression 68 provides enough friction to immobilize the gauge plate 69, while allowing its repositioning under finger pressure. The gauge plate can be fixedly secured by tightening one or both screws 169S accessible on the left wall of the knee-pad. A second pair of flat-head nibs 75 located near the back edge of the slab allows for the placement of the gauge plate in a rearward position where it can extend beyond the rear edge of the slab. An orthogonal projection 76 along the rear edge of the gauge plate 69 provides a convenient key to position the knee-pad as will be explained below. When the knee-pad is not used as a positioning gauge, the gauge plate 69 is flipped over and mounted on the second pair of flat-head nibs 75 with the orthogonal projections 76 abutting the rear wall of the pad as illustrated in FIG. 1.

Figures 10, 11, 12, 13, 14:
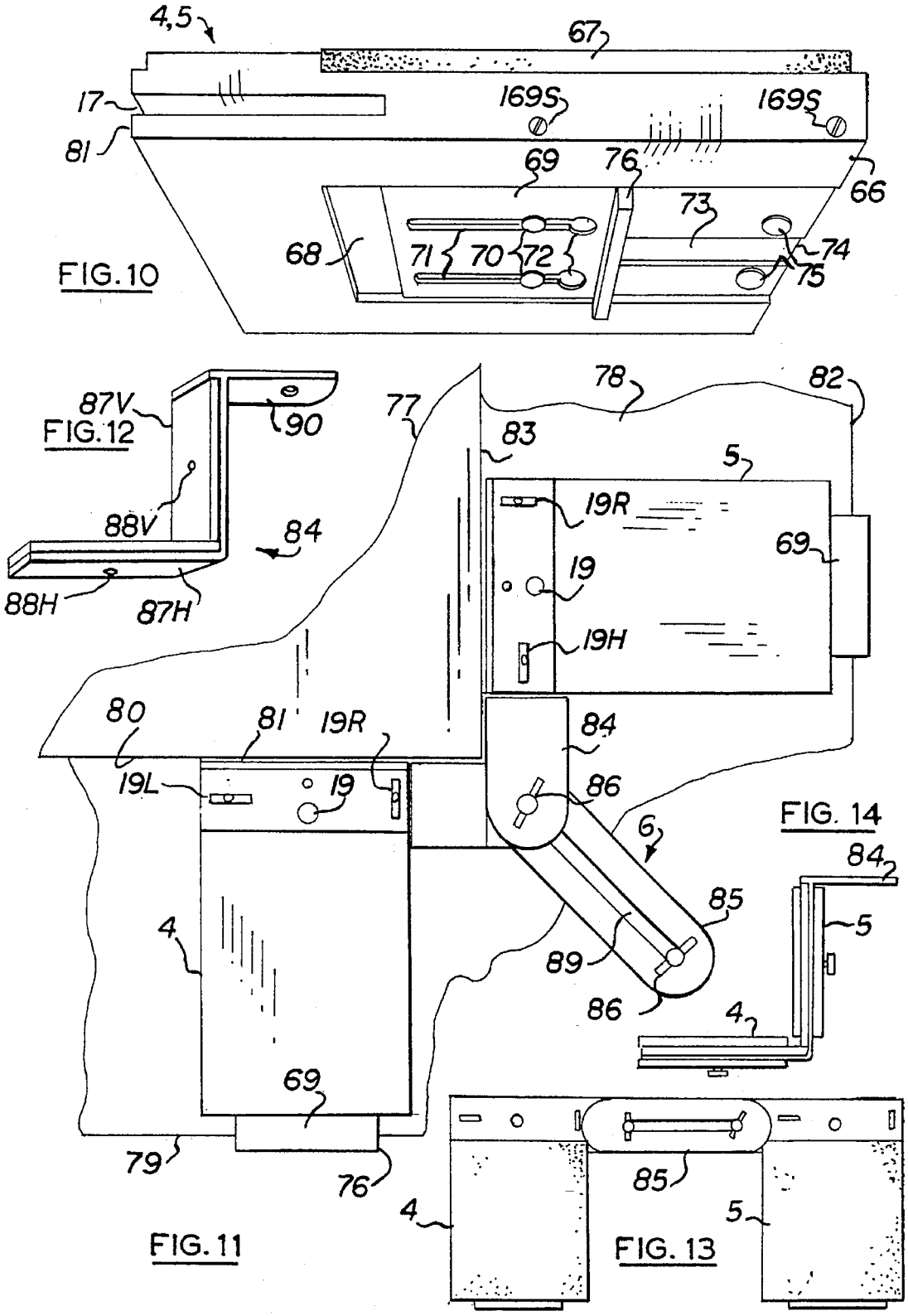
FIG. 10 is a perspective view of a knee-pad showing the underlaid gauge plate.
FIG. 11 is a top plan view of a pair of connected knee-pads used as shingle-positioners.
FIG. 12 is a perspective view of a knee-pad connector leg.
FIG. 13 is a top plan view of a pair of connected knee-pads used as a weather exposure gauge.
FIG. 14 is a side view of a pair of knee-pads connected for use as a beam or post leveling device.

FIG. 11 illustrates how the two knee-pads 4, 5 can be interconnected and positioned by means of the connector 6 to place a shingle 77 in the proper relationship with a previously laid shingle 78. One knee-pad 4 is used to set the weather exposure between the lower edge 79 of the previously laid shingle 78 and the lower edge 80 of the new shingle 77. With the rearward projection 76 of the gauge plate 69 resting against the lower edge of the previously laid shingle, the new shingle 77 is placed in contact with the frontal edge 81 of the knee-pad. The sidelap is similarly determined using the second knee-pad 5 by resting the orthogonal projection of the gauge plate against the right exposed edge 82 of the previously laid tile 78 and aligning the right edge 83 of the new shingle with the front end of the knee-pad. The two knee-pads are held in an orthogonal arrangement by means of the connector 6 so that they can be conveniently moved together from one shingle location to the next.

The knee-pad connector 6 comprises two legs 84 as the one illustrated in FIG. 12, a bridge plate 85, and a pair of wing-nut and bolt fasteners 86. Each leg 84 comprises two rectangular slabs 87V and 87H forming a square angle. Each rectangular slab is dimensioned to fit snugly into, and completely fill the slots 17 of the knee-pads. Bores 88V and 88H in the center of the rectangular slabs are positioned to be engaged by the pins 19 of the knee-pads. A connector plate 90 projects perpendicularly from the top edge of one of the rectangular slabs. One of the fasteners 86 slidingly engaged through the central slot 89 of the bridge plate 85 is used to interconnect the connector plates 90 of the two legs 84.

The two knee-pads can be interconnected in a parallel arrangement illustrated in FIG. 13 to establish the proper spacing between shingles according to the selected weather exposure or sidelap. The rectangular slabs 87V or 87H filling the slots 19 prevent the edge of a shingle from being caught into the slot during installation.

One of the legs 84 may be used to interconnect the two knee-pads as illustrated in FIG. 14 to create two orthogonal planar gauging surfaces. Each knee-pad 4,5 has a set of bubble levels 19L, 19R perpendicular to each other but in the same plane on the top surface of the knee-pad. When the knee-pads are coupled in the perpendicular configuration illustrated in FIG. 14, they may be used to plomb the position of a horizontal beam, a vertical post, or a similar structure.

Figures 15, 16, 17, 18:
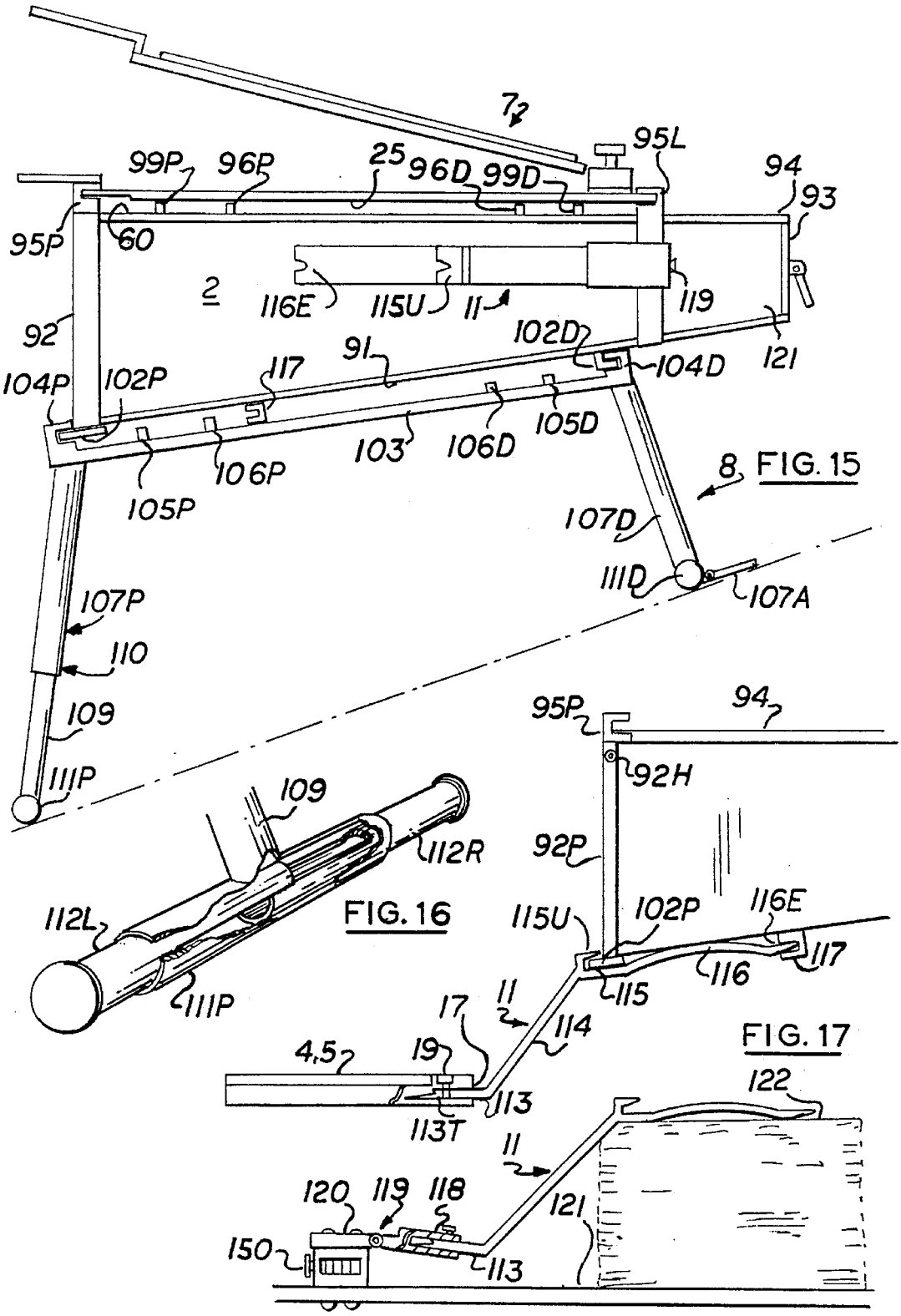
FIG. 15 is a side elevational view of a bench, tool box and cutting guide assembly.
FIG. 16 is a detail view of the bench extendible foot.
FIG. 17 is a side elevational view of the brace, knee-pad and tool box assembly.
FIG. 18 is a side elevational view of the brace used as a shingle wrapper holder.
Figure 19:
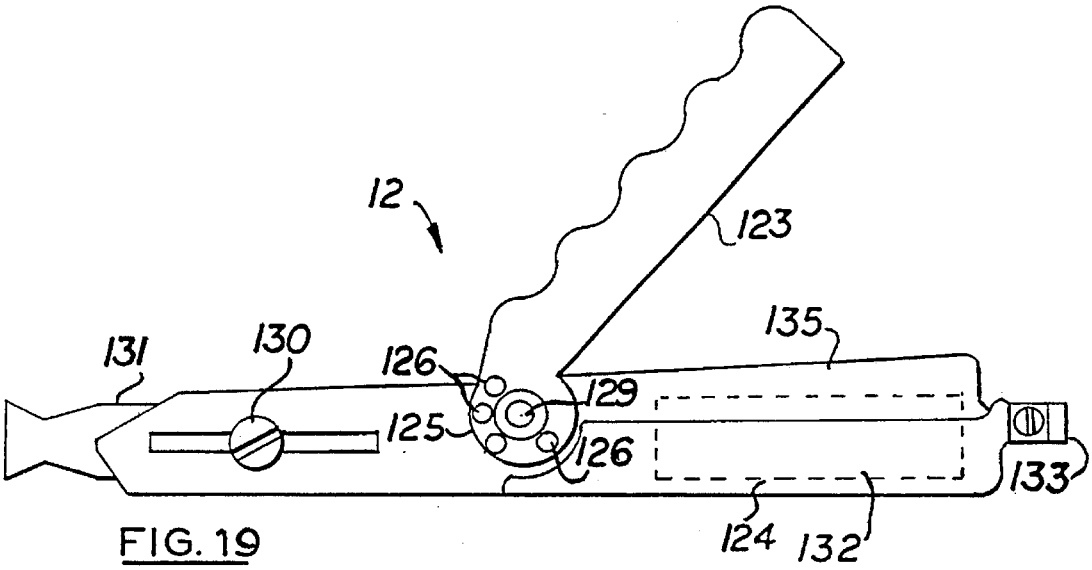
FIG. 19 is a right side elevational view of the knife.
Figure 20:
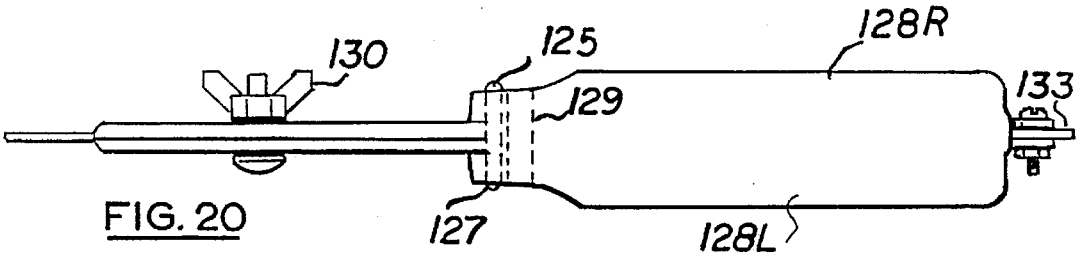
FIG. 20 is a bottom plan view thereof.
Figure 21:
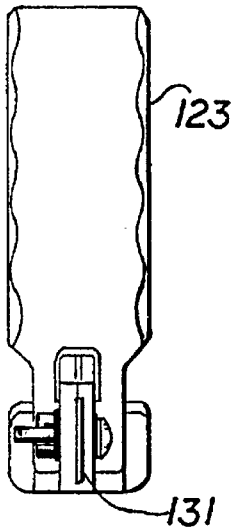
FIG. 21 is a front elevational view thereof.
Figure 22:
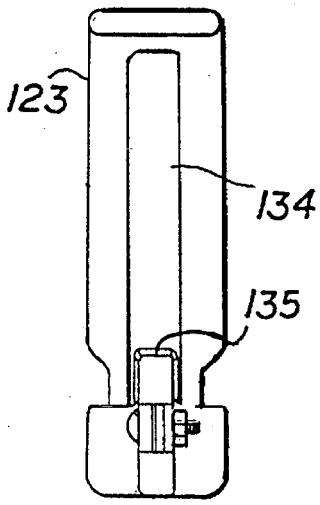
FIG. 22 is a back elevational view thereof.

As illustrated in FIG. 15, the tool box 2 has a generally trapezoidal shape with the bottom 91 of the box slanting downwardly and forwardly so that the frontal side 92 is higher than the back side 93. The tool box can thus rest on the slanted surface of a roof and still provide a relatively horizontal top working surface 94. If the pitch of the roof is substantially greater than the slant of the bottom 91 of the box, the brace 11 can be used in conjunction with one of the knee-pads 4, 5 to raise the frontal end of the box as illustrated in FIG. 17, and still provide a relatively horizontal top work surface 94.

The frontal side 92 has a panel 92P attached at its upper edge by a hinge 92H so that it can be conveniently opened to dump any debris collected during the trimming operation described in connection with FIG. 7.

Parallel U-channels 95P, 95L are mounted on the cover 60 of the box, and are sized and spaced apart to engage the front and back edges of the cutting guide base plate 25. A first pair of spaced apart, cylindrical studs 96P, 96D extend upwardly from the top cover to meet the undersurface of the base plate 25. These studs are sized and positioned to engage either the end bore 97 or the central slot 98 of the swinging work support 10. Spaced apart cylindrical studs 99P, 99D are designed to engage the slots 100P, 100D in the ends of the sliding work support 9. Either or both of the work supports can thus be used in connection with the tool box acting as a work bench. Two parallel rails 102P, 102D are mounted against the bottom surface 91 of the tool box at distances corresponding to the length of the cutting guide sole plate 25. The work bench 8 has a table 103 whose upper surface is an exact replica of the upper surface 60 of the tool box including U-channels 104P, 104D and pairs of cylindrical studs 105P, 105D and 106P, 106D respectively. Accordingly, the cutting guide 7 can either be mounted on top of the tool box, or directly on top of the tool bench. The tool box can act as a bench either resting directly on a roof surface, propped by the brace 11, or mounted on the work bench 8 as illustrated in FIG. 15. Two T-bars 107P, 107D are used as the front and back legs of the work bench 8. The T-bars are rotatively connected at their upper ends into corresponding slots of the table 103 so that they can be folded inwardly for storage or transportation while the work bench 8 is still connected to the bottom of the tool box 2. The front leg 107P has a telescopic extension 109 which can be adjusted and immobilized by a wing-screw 110. The foot 111P of the front leg extension 109 houses a set of lateral, telescopic extensions 112L, 112R, illustrated in FIG. 16, which provide additional stability for the work bench and cutting guide assembly. The back leg 107D of the bench 8 has an anchoring plate 107A rotatively linked to the foot 111D. The anchoring plate has a slot 107S sized to engage an anchoring nail driven into the roof or other supporting surface.

As illustrated in FIG. 17, the brace 11 has a foot 113 which is sized and bored to penetrate the slot 17 of a knee-pad 4, 5 and be immobilized by its interlocking pin 19. The tip 113T of the foot 113 is pointed and tapered to act as a staple extractor. The leg 114 of the brace rises at a slight oblique angle from the foot and supports at its end a U-channel 115 designed to engage the rail 102P at the bottom of the tool box 2, and has an arched upper arm 116 whose end 116E engages into a third U-channel 117 mounted on the bottom 91 of the tool box. The end 116E of the arm is tapered and slotted to form a nail puller. The upper edge 115U of the U-channel is also tapered and V-notched to also form a nail puller, and to be insertable under the edge of a shingle to be scraped. The foot 113 of the brace is also designed to be connected to a wing 118 of a spring-biased hinge 119, the second wing 120 of which is fastened against one side 121 the tool box or, alternately, to the sliding support 9. In either case, the brace 11 can be used to clamp down an accumulation of shingle wrappers 122 as shown in FIG. 18 which have been collected to prevent them from being blown away. The collected wrappers can also be counted at the end of the day to determine the number of shingles installed, and to compute the corresponding work remuneration.

The brace 11 can, thus act as a support, a staple extractor, nail puller, a shingle scraper, and a wrapper clamp.

A manually-stepped counter 150 is installed between the spring-biased hinge 120 and the side wall 121 of the tool box, and can be used to accumulate the number of shingles, tiles or wrappers processed by the roofer.

The blade knife 12, illustrated in FIGS. 19–22, is characterized by an auxiliary handle 123 which can be deployed from a folded position integral with the main handle 124 to a choice of oblique or perpendicular orientations. The auxiliary handle 123 can be immobilized to a choice of positions by placing a pin 125 through one of plurality of holes surrounding the handle pivot 126 and a corresponding bore 127 through the central part of the knife body. The knife comprises two symmetrical halves 128L, 128R rotatively joined by the auxiliary handle pivot pin 129. The two halves 128L, 128R of the knives are locked together by a wing-nut fastener 130 which also is used as in previous blade knife design, to immobilize the blade 131 in its working position. A cavity 132 in the principal handle section 124 of the knife provides a convenient storage for spare blades. One half of the knife body 128L has a rearward projection 133 shaped as a screwdriver tip. The auxiliary handle 123 has a generally arcuate cross-section which defines a central groove 134 that can cap the narrower upper half 135 of the main handle portion 124.

The gauge 1, more specifically illustrated in FIGS. 13 and 23–25 comprises an angle ruler 136 rotatively connected at one end to a stationary arm 137 by a first wing-nut fastener 138. A second arm 139 is slidingly connected by means of a second wing-nut fastener 140 through a longitudinal slot 141 in the angle ruler 136. The second arm 139 is secured to the angle ruler by a central slot 142 which allows longitudinal, lateral as well as angular orientation in relationship to the ruler 136. The ruler incorporates a bubble level 143. The ruler and the arms have ruled edges 144, 145 and 146.

Figure 23:
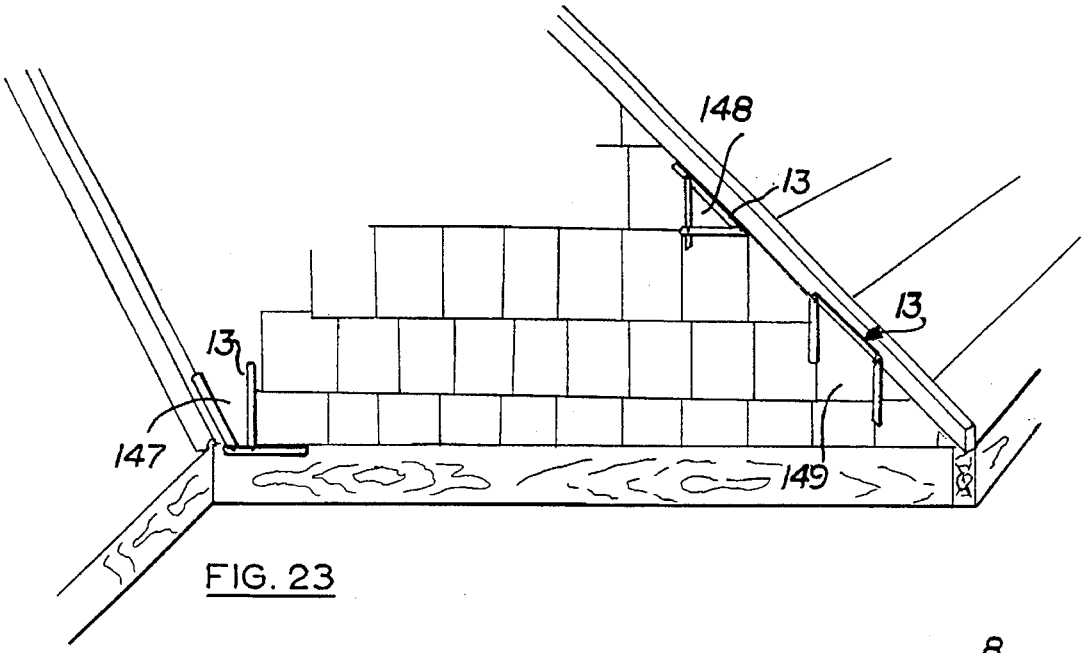
FIG. 23 is a perspective view of a roof structure illustrating various uses of the tile gauge.
Figure 24:
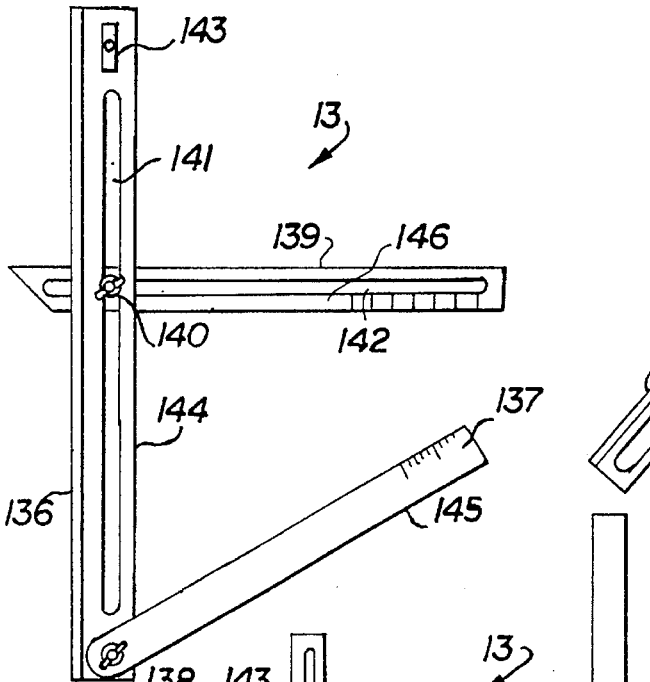
FIG. 24 is a top plan view of the tile gauge.

As shown in FIG. 23, the gauge 13 can be used to size a variety of tile or shingle cuts 147,148 and 149 which must be made to complete a row of tile or shingles in the proximity of a valley or a hip of a roof structure.

Figure 25:
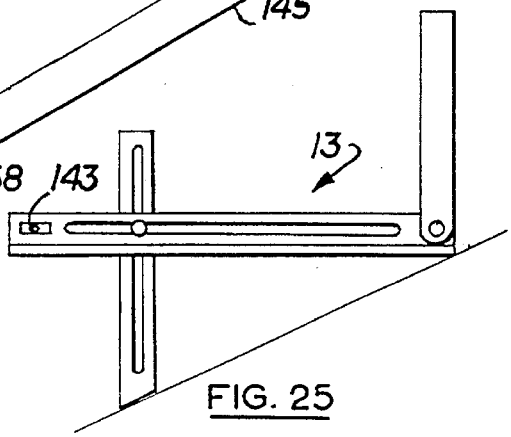
FIG. 25 illustrates an alternate use of the tile gauge.

FIG. 25 illustrates the use of the gauge 13 as a roof pitch or angle finder. This application of the gauge is particularly convenient for determining whether the pitch of the roof exceeds a building code limit above which specified waterproofing treatment must be applied to the roof, and battens must be installed to stabilize the tiles. The pitch of the roof must also be taken into consideration when manufacturing sidewalls and flashings to be installed around skylights, chimneys, vent holes and other structures jutting out of the roof surface.

Figure 26:
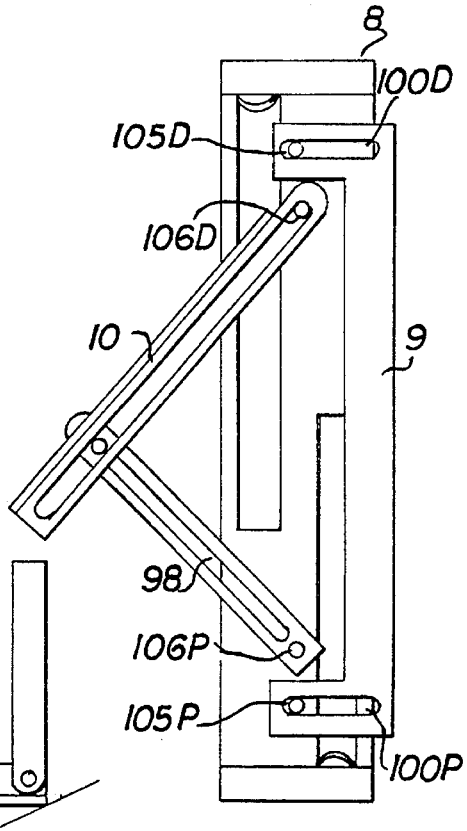
FIG. 26 is a top plan view of the bench and tile supports.

FIG. 26 illustrates the use of the tile supports 9 and 10 in connection with the bench 8. This use of the tile supports is similar to the one disclosed in connection with the tool box 2 acting as a bench. The sliding panel support 10 can be conveniently used to align a tile for oblique cuts.

Figure 31:
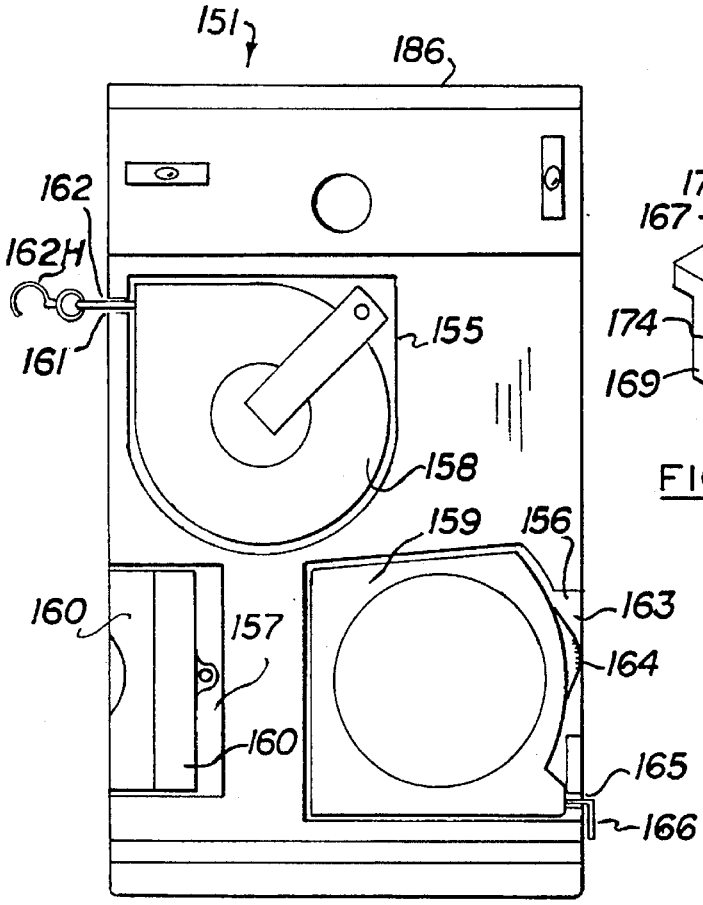
FIG. 31 is a top plan view of the alternate embodiment of the knee-pad with its cover in the open position.
Figure 32:
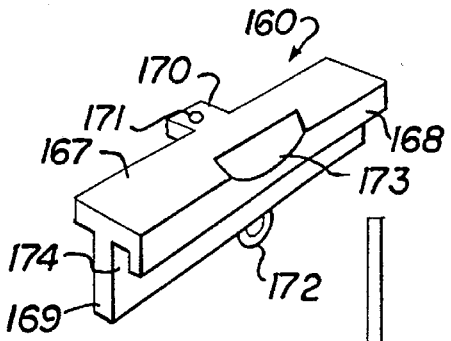
FIG. 32 is a perspective view of a chalk line anchor.

The alternate embodiment 151 of the knee-pads more specifically illustrated in FIGS. 27, 30 and 31, features an hinge cover plate 152 on the top surface of which is bonded the knee-cushion 153. The cover plate can be rotated about its rear edge hinge 154 to expose three cavities 155, 156, and 157 that are shaped and dimensioned to tightly receive a chalk line container 158, a coiled tape ruler 159, and a chalk line anchor 160 respectively. A slot 161 in the left wall of the first cavity provides a convenient passage for the chalk line 162. A window 163 in the right side of the second cavity provides finger access to the tape locking control 164. A slot 165 near the rear end of the left wall provides a convenient passage for the tape 166. The chalk line anchor 160 illustrated in FIG. 32 has a front plate 167 with an outer surface flush with the outer left wall of the knee-pad when the anchor nests in its cavity 157. The front plate has a flange 168 along one edge projecting orthogonally inward. A leg 169 has the same thickness as the width of the knee-pad slot 17. A projection 170 of the front member opposite the side of the flange has a nail-hole for securing the anchor. A ring or eyelet 172 projecting from the median section of the leg 169 is dimensioned to receive the hook 162H at the end of the chalk line 162. A bubble level 173 is located at the middle of the intersection of the front member 167 and flange 168. The slot or recess 174 between the inner side of the flange 168 and the leg 169 is dimensioned to engage the edge of a shingle to which the chalk line is to be anchored.

Figure 34:
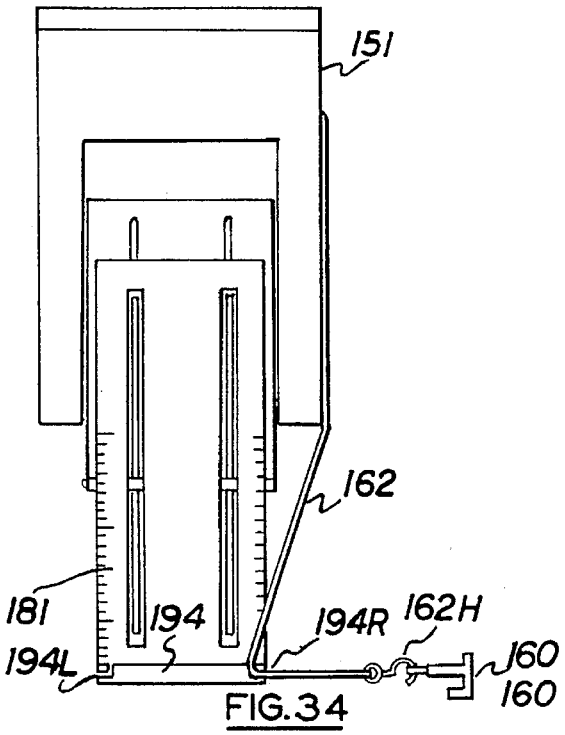
FIG. 34 is a bottom plan view of the knee-pad and gauge plate assembly.

A gauge plate 175 illustrated in FIGS. 27 and 34 is basically similar in form and function as the one 69 described earlier, except that its rear stop is constituted by two square-headed nibs 177, 178 symmetrically spaced apart from the center of the gauge plate, and barriers 179, 180. These nibs and barriers are designed to hold a gauge plate extension 181 when the gauge plate 175 is flipped over into its use position. The gauge plate extension illustrated in FIGS. 29 and 34 has two parallel slots 182, 183 which are shaped and dimensioned to slidingly receive the nibs of the gauge plate. The width of the gauge plate extension corresponds to the inner spacing between the two barriers 179, 180. One barrier 179 has a horizontally transversal tightening screw 179S for immobilizing the extension 181 under the gauge plate 175. The square holes 184, 185 are dimensioned to allow engagement with the square heads of the nibs 177, 178.

Figure 33:
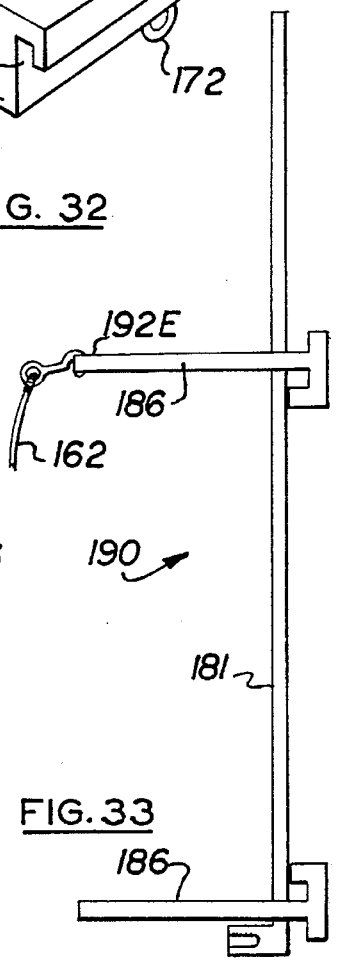
FIG. 33 is a side view of a roof-edge clamp.

A slot filling and clamping plate 186 illustrated in FIG. 28 has a front plate 187 and flange 188 similar to the ones of the chalk line anchor 160, but the leg 189 is long enough to entirely fill the slot 17 of the knee-pad. An eyelet 192E along the inner edge of the leg is dimensioned to receive the hook 162H of the chalk line. A transversal slot 191 is dimensioned to receive the gauge plate extension 181 inserted therethrough perpendicularly to the leg 189 to form a clamping assembly 190 as shown in FIG. 33. An hexagonal hole 192H in the middle of the leg is designed to receive the lower tip of the locking pin 19. A pair of nail holes 193 in the leg are provided to secure the slot filling and clamping plate to a roof structure.

As illustrated in FIG. 30, the assembly combining the knee-pad 151, the slot filling and clamping plate 186, the gauge plate 175 and its extension 181 can be used to measure or to set weather exposure, sidelap, or other spacing during the roofing operation.

The clamping assembly 190 is constituted by two slot-filling and clamping plates 186 engaged over the gauge plate extension 181. A support structure can be clamped between the two legs of the slot-filling and clamping plates 186. A chalk line can be secured to the eyelets 192E at the ends of either one of the two slot-filling and clamping plates as illustrated in FIG. 33.

Figure 35:
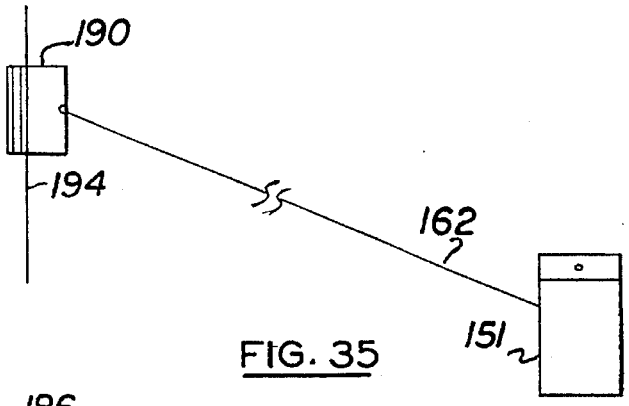
FIG. 35 is a diagrammatical illustration of a first use of the chalk line and knee-pad.
Figure 36:
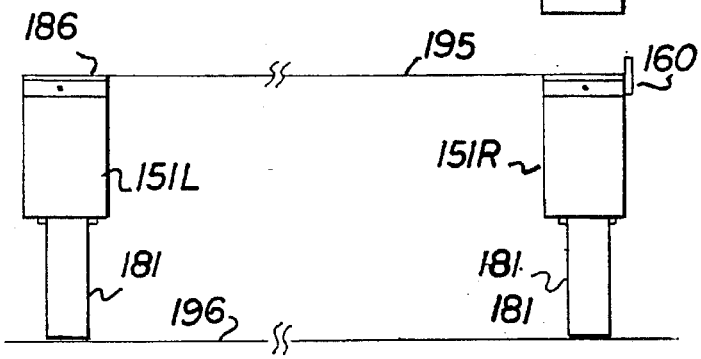
FIG. 36 is a diagrammatical illustration of a second use of the chalk line and knee-pad.

FIG. 34 shows how the chalk line 162 can be passed through one of a pair of slots 194L, 194R in the rear stop 194 of the gauge plate extension 181, then attached to either the anchor 160 or the clamping assembly 190 to achieve various chalk line marking tasks. Two of such tasks are illustrated in FIGS. 35 and 36. In FIG. 35, the end of the chalk line is attached to a clamping assembly 190 installed along the edge 194 of a roof. In FIG. 36, the chalk line coming out of a first left-side knee-pad 151L is tightly wrapped around the front of the slot-filling and clamping plate 186 of that pad then connected at the other end to a chalk line anchor 160 having its leg inserted into the right opening of the slot 17 of another knee-pad and gauge plate assembly 151R. Such an arrangement can be used to mark the spacing between two courses 195, 196 of tiles or shingles.

Figure 37:
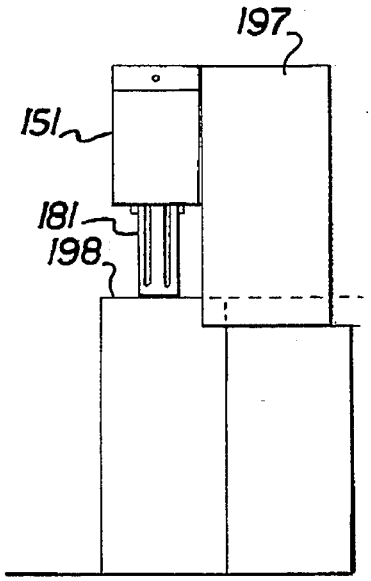
FIG. 37 is a diagrammatical illustration of the use of the knee-pad as a tile gauge.
Figure 38:
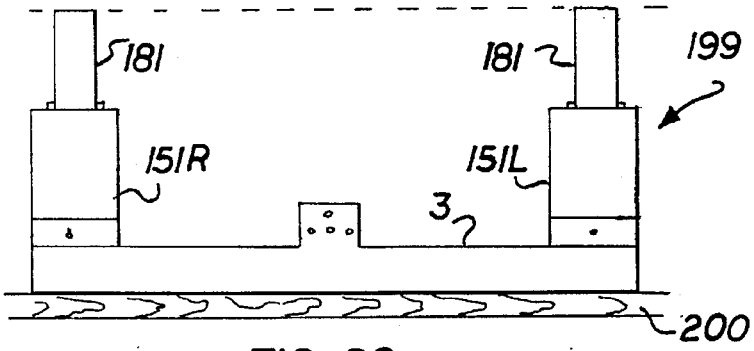
FIG. 38 is a diagrammatical illustration of the knee-pads and ruler assembly used as a spacing gauge.
Figure 39:
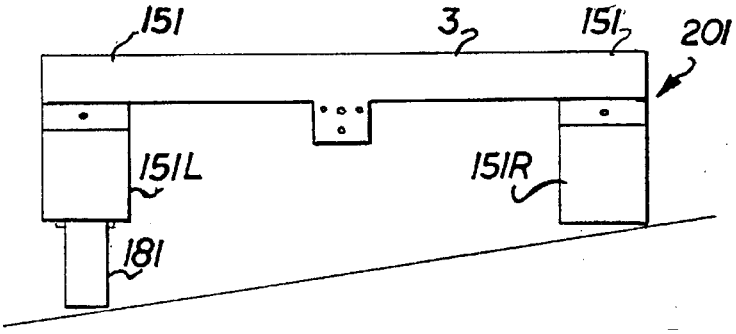
FIG. 39 is a diagrammatical illustration of the knee-pads and ruler assembly used as a roof pitch finder.
Figure 40:
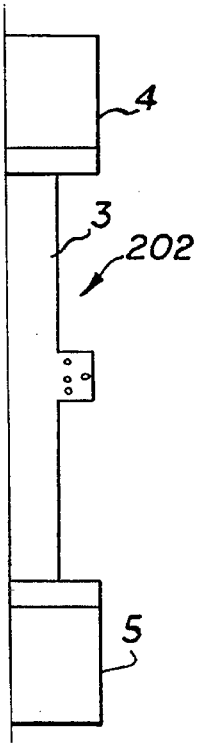
FIG. 40 is a diagrammatical illustration of the knee-pads and ruler assembly used as a torpedo level.

As shown in FIG. 37, the knee-pad and gauge plate assembly can also be used to position an upper course tile 197 by reference to a lower course 198 of tiles.

FIGS. 37–40 illustrate how a pair of knee-pads can be combined with a ruler 3 to form a spacing gauge 199 when installing tile-retaining battens 200; to form a roof pitch gauge 201, or form a torpedo level 202.

It should be noted that the front and back face of the gauge plates 69, 175, and the gauge plate extension 181 can be engraved with a variety of spacing measurements 203, as well as provide a convenient display for a fractional to decimal conversion table 204.

While the preferred embodiments of the invention have been described, modifications can be made and other embodiments may be devised without departing from the spirit of the invention and the scope of the appended claims.

What is claimed is:

1. A set of cooperating tools for use while installing roofing shingles or tiles over a roof surface, which comprises:

first and second knee-pads, each of said knee-pads having a flat, unencumbered bottom surface shaped for direct contact with said roof surface and at least one straight solid aligning edge; and releasable means for fixedly interconnecting said knee-pads in a plurality of arrangements including means for positioning the aligning edge of one of said knee-pads perpendicularly to the aligning edge of the other knee-pad.

2. A set of cooperating tools for sizing and positioning roofing shingles or tiles, which comprises:

first and second knee-pads, each of said knee-pads having at least one straight solid aligning edge; and means for fixedly interconnecting said knee-pads in a plurality of spaced-apart arrangements;

wherein said means for interconnecting comprises:

a ruler having a first straight edge along a first side; and means for attaching either one of said knee-pads to said ruler at a first location proximate to a first end of said ruler, at a second location proximate an opposite end of said ruler, and at a third location in a median portion of said ruler.

3. The set of claim 2, wherein said ruler further comprises at least three projections along a second side opposite said first side, each one of said projections being proximate one of said first, second and third locations.

4. The set of claim 3, wherein each of said knee-pads has a cavity along its forward edge, said cavity being sized and dimensioned to receive either one of said projections.

5. The set of claim 2, wherein said ruler further comprises measuring indicia marked along said straight edge.

6. The set of claim 5, which further comprises:

a cutting guide; and means for positioning said cutting guide in a angled position in relation to said straight edge.

7. The set of claim 6, wherein said cutting guide comprises:

a sole-plate; and a knife-guiding arm hingedly connected at one of its ends to one end of said sole-plate.

8. The set of claim 7, wherein said knife-guiding arm has a second straight edge, and said sole-plate has a groove concurrent with said second straight edge.

9. The set of claim 6, which further comprises:

an oblong box shaped and dimensioned to house said ruler, knee-pads and cutting guide;

a pair of brackets attachable to said ruler, said brackets being shaped and dimensioned to position said box downwardly and parallelly spaced-apart from the straight edge of said ruler;

whereby said box lies below a roof ledge to receive shingle trimmings when the straight edge of said ruler is placed along and above said ledge for delineating a width of shingles to be trimmed back.

10. The set of claim 2, which further comprises:

a shingle knife having an oblong first handle;

a cutting blade having a portion extending beyond one end of said first oblong handle; and a second oblong handle projecting from one side of said first oblong handle.

11. The set of claim 9 which further comprises means for securely mounting said cutting guide on top of said box.

12. The set of claim 11 which further comprises:

a collapsible work bench; and means for securely mounting said box on top of said work bench.

13. The set of claim 12, wherein said means for mounting said cutting guide and said means for mounting said box comprise symmetrical interlocking means, whereby said cutting guide may be securely mounted on top of said box and on top of said work bench.

14. The set of claim 2, wherein at least one of said knee-pads comprise a level indicator.

15. The set of claim 2, wherein at least one of said knee-pad has a cavity shaped and dimensioned to house a chalk line container.

16. The set of claim 2, wherein at least one of said knee-pads has a cavity shaped and dimensioned to house a tape measure.

17. A set of cooperating tools for use while installing roofing shingles or tiles, which comprises:

first and second knee-pads, each of said knee-pads having at least one straight solid aligning edge; and means for fixedly interconnecting said knee-pads in a plurality of spaced-apart arrangements;

said means for interconnecting comprising a handle and means for attaching opposite ends of said handle to each one of said knee-pads;

wherein said means for attaching comprises means for positioning the aligning edge of one of said pads perpendicularly to the aligning edge of the other pad.

18. The set of claim 17, wherein at least one of said pads comprises a ruled bracket having a downward projecting ledge parallel to the aligning edge of said pad, and means for moving said bracket and adjusting the position of said ledge in relation to the aligning edge of said pad.

19. The set of claim 18, wherein said pad further comprises an upper layer of cushioning material.

* * * * *